US009083156B2

(12) United States Patent
Ma et al.

(10) Patent No.: US 9,083,156 B2
(45) Date of Patent: Jul. 14, 2015

(54) ELECTRODE CORE MATERIAL FOR SPARK PLUGS

(71) Applicant: FEDERAL-MOGUL IGNITION COMPANY, Southfield, MI (US)

(72) Inventors: Shuwei Ma, Anna Arbor, MI (US); Richard L. Keller, Whitehouse, OH (US); John A. Burrows, Altrincham (GB)

(73) Assignee: Federal-Mogul Ignition Company, Southfield, MI (US)

( * ) Notice: Subject to any disclaimer, the term of this patent is extended or adjusted under 35 U.S.C. 154(b) by 16 days.

(21) Appl. No.: 14/173,451

(22) Filed: Feb. 5, 2014

(65) Prior Publication Data

US 2014/0232254 A1 Aug. 21, 2014

Related U.S. Application Data

(60) Provisional application No. 61/765,246, filed on Feb. 15, 2013.

(51) Int. Cl.
*H01T 13/39* (2006.01)

(52) U.S. Cl.
CPC ..... *H01T 13/39* (2013.01)

(58) Field of Classification Search
CPC ..... H01T 13/39
USPC ..... 313/118–145
See application file for complete search history.

(56) References Cited

U.S. PATENT DOCUMENTS

| | | | | | |
|---|---|---|---|---|---|
| 2,146,722 | A | * | 2/1939 | Darby | 420/497 |
| 2,311,750 | A | | 2/1943 | Hensel et al. | |
| 2,842,438 | A | | 7/1958 | Saarivirta et al. | |
| 3,357,824 | A | | 12/1967 | Saarivirta | |
| 3,392,016 | A | | 7/1968 | Opie et al. | |
| 3,421,888 | A | | 1/1969 | Saarivirta | |
| 3,892,216 | A | | 7/1975 | Danis | |
| 4,093,887 | A | | 6/1978 | Corbach et al. | |
| 4,198,248 | A | | 4/1980 | Mandigo et al. | |
| 4,314,392 | A | | 2/1982 | Waite | |
| 4,400,643 | A | * | 8/1983 | Nishio et al. | 313/11.5 |
| 4,514,657 | A | | 4/1985 | Igashira et al. | |
| 4,585,421 | A | | 4/1986 | Payne | |
| 4,606,730 | A | | 8/1986 | Kin et al. | |
| 4,631,237 | A | | 12/1986 | Dommer et al. | |
| 4,695,759 | A | | 9/1987 | Podiak | |
| 4,742,265 | A | | 5/1988 | Giachino et al. | |
| 4,755,235 | A | | 7/1988 | Matidori et al. | |
| 4,808,135 | A | * | 2/1989 | Sakura et al. | 445/7 |
| 4,814,665 | A | * | 3/1989 | Sakura et al. | 313/141 |
| 4,834,808 | A | | 5/1989 | Hill | |
| 4,904,216 | A | | 2/1990 | Kagawa et al. | |

(Continued)

FOREIGN PATENT DOCUMENTS

JP 93048596 * 7/1993 ..... H01T 13/39

*Primary Examiner* — Thomas A Hollweg
(74) *Attorney, Agent, or Firm* — Reising Ethington P.C.

(57) ABSTRACT

An electrode core material that may be used in electrodes of spark plugs and other ignition devices to provide increased thermal conductivity to the electrodes. The electrode core material is a precipitate-strengthened copper alloy and includes precipitates dispersed within a copper (Cu) matrix such that the electrode core material has a multi-phase microstructure. In several exemplary embodiments, the precipitates include: particles of iron (Fe) and phosphorous, particles of beryllium, or particles of nickel and silicon.

10 Claims, 3 Drawing Sheets

(56) References Cited

U.S. PATENT DOCUMENTS

| | | | | | |
|---|---|---|---|---|---|
| 4,949,006 | A | | 8/1990 | Oshima et al. | |
| 4,964,926 | A | | 10/1990 | Hill | |
| 4,967,116 | A | | 10/1990 | Oshima | |
| 5,017,826 | A | * | 5/1991 | Oshima et al. | 313/142 |
| 5,107,169 | A | | 4/1992 | Schneider et al. | |
| 5,210,457 | A | | 5/1993 | Oshima et al. | |
| 5,273,474 | A | | 12/1993 | Oshima et al. | |
| 5,292,477 | A | | 3/1994 | Chance et al. | |
| 5,306,465 | A | | 4/1994 | Caron et al. | |
| 5,310,373 | A | | 5/1994 | Treiber et al. | |
| 5,347,193 | A | | 9/1994 | Oshima et al. | |
| 5,370,840 | A | | 12/1994 | Caron et al. | |
| 5,395,273 | A | | 3/1995 | Matsutani | |
| 5,497,045 | A | | 3/1996 | Matsutani et al. | |
| 5,514,929 | A | * | 5/1996 | Kawamura | 313/141 |
| 5,578,894 | A | * | 11/1996 | Oshima | 313/141 |
| 5,578,895 | A | | 11/1996 | Oshima | |
| 5,675,209 | A | * | 10/1997 | Hall et al. | 313/141 |
| 5,743,777 | A | | 4/1998 | Demeuter | |
| 5,943,749 | A | | 8/1999 | Swank | |
| 5,973,443 | A | | 10/1999 | Chang et al. | |
| 5,980,345 | A | | 11/1999 | Chang et al. | |
| 6,045,424 | A | | 4/2000 | Chang et al. | |
| 6,093,499 | A | | 7/2000 | Tomioka | |
| 6,113,761 | A | | 9/2000 | Kardokus et al. | |
| 6,528,929 | B1 | | 3/2003 | Matsutani et al. | |
| 6,677,698 | B2 | | 1/2004 | Labarge et al. | |
| 6,759,795 | B2 | | 7/2004 | Kumagai et al. | |
| 7,150,252 | B2 | | 12/2006 | Sugiyama et al. | |
| 7,298,070 | B2 | | 11/2007 | Kanao | |
| 8,072,125 | B2 | | 12/2011 | Torii et al. | |
| 8,288,927 | B2 | * | 10/2012 | Ma et al. | 313/118 |
| 8,816,577 | B2 | * | 8/2014 | Ma et al. | 313/118 |
| 2002/0074919 | A1 | * | 6/2002 | Labarge et al. | 313/141 |
| 2002/0155021 | A1 | | 10/2002 | Nagai et al. | |
| 2004/0080252 | A1 | | 4/2004 | Ito et al. | |
| 2005/0023949 | A1 | | 2/2005 | Hori | |
| 2006/0082276 | A1 | | 4/2006 | Havard et al. | |
| 2007/0272430 | A1 | | 11/2007 | Tuffile et al. | |
| 2007/0290591 | A1 | | 12/2007 | Lykowski et al. | |
| 2007/0290593 | A1 | | 12/2007 | Kowalski | |
| 2008/0030116 | A1 | | 2/2008 | Joseph et al. | |
| 2008/0122334 | A1 | * | 5/2008 | Kishimoto et al. | 313/141 |
| 2008/0308057 | A1 | | 12/2008 | Lykowski et al. | |
| 2009/0051259 | A1 | | 2/2009 | Yoshimoto | |
| 2009/0107440 | A1 | | 4/2009 | Lykowski et al. | |
| 2009/0189502 | A1 | | 7/2009 | Suzuki et al. | |
| 2011/0037370 | A1 | | 2/2011 | Ma et al. | |
| 2013/0063017 | A1 | * | 3/2013 | Ma et al. | 313/141 |

* cited by examiner

ELECTRODE CORE MATERIAL FOR SPARK PLUGS

REFERENCE TO RELATED APPLICATIONS

This application claims the benefit of U.S. Provisional Ser. No. 61/765,246 filed on Feb. 15, 2013, the entire contents of which are incorporated herein.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperature gradients, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To help control or reduce the operating temperature of the spark plug electrodes, the electrodes may include a core made of a material having a high thermal conductivity, such as copper (Cu), to help conduct heat away from a sparking end of the spark plug electrodes. The copper core may be surrounded or covered by a cladding or sheath of a material having corrosion and erosion resistant properties, such as nickel (Ni). However, traditional copper cored electrodes can sometimes experience relaxation and/or swelling issues when used in engines running periodically between full throttle and idle operation. In such operation, the electrodes experience significant temperature gradients, which in turn can create thermal stresses that can result in electrode creep, changes to the spark gap, as well as other unwanted consequences.

SUMMARY

According to one embodiment, there is provided an electrode core material for use in a spark plug electrode. The electrode core material may comprise: a copper matrix made of a copper-based material, wherein copper is the single largest constituent of the copper matrix by weight; and a plurality of precipitates dispersed in the copper matrix, wherein the precipitates strengthen the copper matrix so that the electrode core material is a precipitate-strengthened copper alloy.

According to another embodiment, there is provided a spark plug electrode. The spark plug electrode may comprise: a core made of a precipitate-strengthened copper alloy including a copper matrix and a plurality of precipitates dispersed in the copper matrix; and a cladding surrounding the core, wherein the cladding is made of a nickel-based material where nickel is the single largest constituent of the nickel-based material by weight.

According to another embodiment, there is provided a spark plug. The spark plug may comprise: a metallic shell having an axial bore; an insulator being at least partially disposed within the axial bore of the metallic shell, the insulator having an axial bore; a center electrode being at least partially disposed within the axial bore of the insulator; and a ground electrode being attached to the metallic shell. The center electrode, the ground electrode, or both the center and ground electrodes include a cladding formed of a nickel-based material and a core comprising a copper matrix and a plurality of precipitates dispersed throughout the copper matrix.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
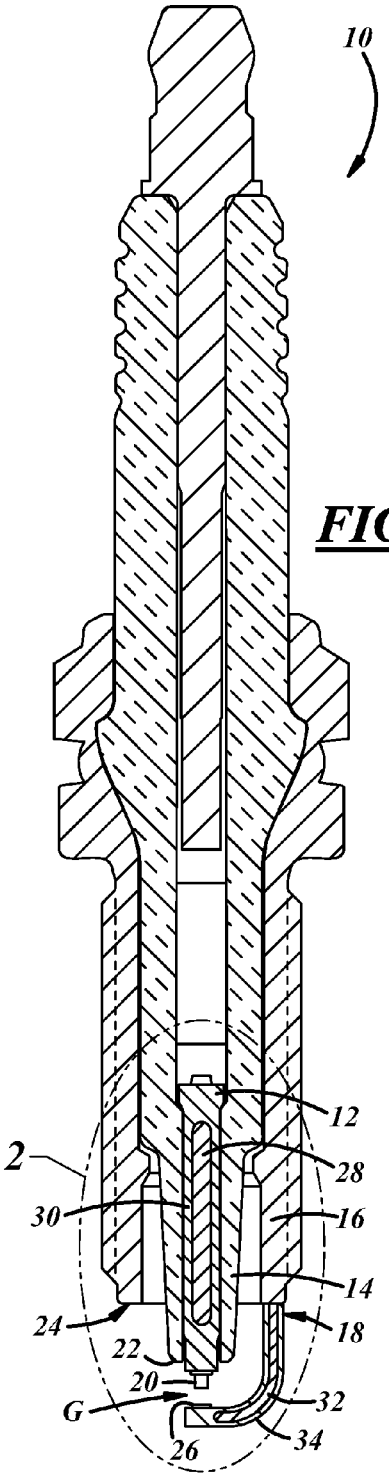
FIG. 1 is a cross-sectional view of an exemplary spark plug that may use the electrode core material described below.

The electrode core material described herein is a thermally conductive, copper-based material that is added to a spark plug electrode in order to manage, control and/or otherwise affect the thermal characteristics of the spark plug firing end. According to one embodiment, the electrode core material possesses a thermal conductivity (e.g., greater than 250 $W \cdot m^{-1} \cdot K^{-1}$) that is great enough to satisfy the thermal requirements of the spark plug electrode, yet also has a strength that is great enough to resist unwanted electrode deformation and thus help avoid relaxation and/or swelling in the electrode. This electrode core material may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and that are described below. Furthermore, it should be appreciated that the electrode core material may be used in both the center electrode and the ground electrode, or it may be used in only one of the center or ground electrodes, to cite several possibilities. Other embodiments and applications of the core material are also possible.

Figure 2:
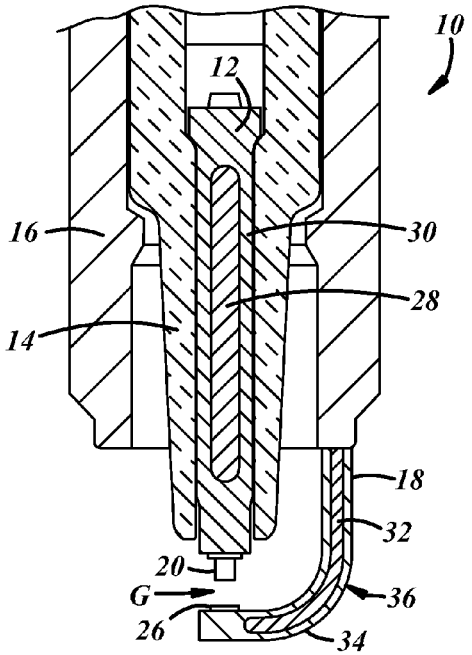
FIG. 2 is an enlarged view of the firing end of the exemplary spark plug from FIG. 1, wherein a center electrode and a ground electrode of the spark plug include a core made of a thermally conductive material.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes an insulated end and a firing end having a firing tip 20 attached thereto that protrudes beyond a free end 22 of the insulator 14. The firing tip 20 may be a single-piece rivet that includes a sparking surface and is made from an erosion- and/or corrosion-resistant material. The insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes an attachment end and a firing end having a side surface that opposes the firing tip 20 of the center electrode and has a firing tip 26 attached thereto. The firing tip 26 may be in the form of a flat pad and includes a sparking surface defining a spark gap G with the center electrode firing tip 20 such that they provide sparking surfaces for the emission and reception of electrons across the spark gap G.

The center electrode 12 and/or the ground electrode 18 may include a core made from a thermally conductive material, such as the electrode core material described below, and a cladding or sheath surrounding the core. The core of the center electrode 12 and/or the ground electrode 18 is preferably designed to help conduct heat away from the firing ends of the electrodes towards cooler portions of the spark plug 10. In the embodiment shown in FIGS. 1 and 2, the center electrode 12 includes a core 28 entirely encased within a cladding 30, and the ground electrode 18 includes a core 32 surrounded by a cladding 34. The core 28 of the center electrode 12 may extend from a location near the firing end of the center electrode 12, through a middle portion of the center electrode, and terminate near the insulated end of the center electrode (the exact length and position of the core 28 can vary depending on the particular embodiment). The core 32 of the ground electrode 18 may extend from a location near the firing end of the ground electrode 18, through a bend 36, to an opposite end of the ground electrode 18, where it may or may not be attached to the free end 24 of the metallic shell 16. It should be noted, however, that the thermally conductive cores 28, 32 of the center and/or ground electrodes may take on any of a variety of shapes, sizes and/or configurations other than those shown in the drawings. For example, in other embodiments, only one of the center or ground electrodes 12, 18 may include a thermally conductive core.

Figure 3:
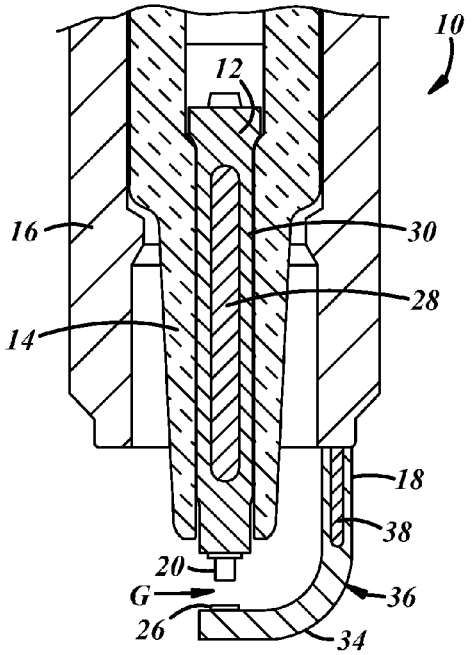
FIG. 3 is an enlarged cross-sectional view of the firing end of another exemplary spark plug, wherein a center electrode and a ground electrode of the spark plug include a core made of a thermally conductive material.
Figure 4:
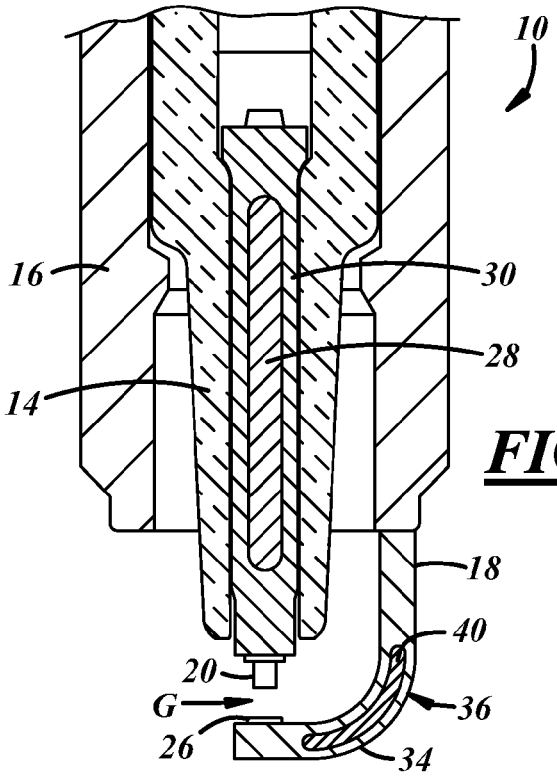
FIG. 4 is an enlarged cross-sectional view of the firing end of yet another exemplary spark plug, wherein a center electrode and a ground electrode of the spark plug include a core made of a thermally conductive material.

Referring now to FIG. 3, the ground electrode 18 may include a core 38 extending from the attachment end towards the firing end of the ground electrode 18, without passing through the bend 36. This results in a shorter core 38 than illustrated in the previous embodiment. In another embodiment, as shown in FIG. 4, the ground electrode 18 may include a core 40 extending through the bend 36, but not reaching either the firing end or the attachment end of the ground electrode 18. As also shown in FIG. 4, the center electrode 12 may include a core 42 which extends from the middle portion to the firing end of the center electrode 12 so that it is in close proximity to the firing tip 20.

It should be appreciated that the non-limiting spark plug embodiments described above are only examples of some of the potential uses for the electrode core material, as it may be used or employed in any firing tip, electrode, or other firing end component that is used in the ignition of an air/fuel mixture in an engine. For instance, the following components may be at least partially formed from or otherwise include the present electrode core material: a center and/or ground electrode; an electrode core that extends all the way to a firing end of a center and/or ground electrode; an electrode core that terminates or stops short of a firing end of a center and/or ground electrode; an electrode core that extends all the way to a free end of a ground electrode so that it directly contacts a spark plug shell; an electrode core that extends all the way underneath a noble metal pad or tip on a side surface of a ground electrode; an electrode core that terminates or stops short of a noble metal pad or tip on a side surface of a ground electrode; an electrode core that radially extends the entire width of a center electrode so that the core forms the outer surface of the center electrode for at least a portion thereof; or a multi-layer center and/or ground electrode where there are multiple core and/or cladding layers. These are but a few examples of the possible applications of the electrode core material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

The electrode core material is a precipitate-strengthened copper alloy and may include precipitates uniformly dispersed within a copper (Cu) matrix. The precipitates and the copper (Cu) matrix have different chemical compositions and different chemical and mechanical properties. Accordingly, the precipitates and the copper (Cu) matrix each contribute a separate set of desirable attributes or characteristics to the core material. In particular, the copper (Cu) matrix provides the core material with high thermal conductivity and suitable ductility for manufacturing, while the precipitates provide the core material with creep and fatigue resistance at high temperatures by impeding dislocation motion across these precipitates, which strengthens the electrode core material.

Inclusion of the precipitates in the copper (Cu) matrix may result in the electrode core material having a thermal conductivity that is somewhat lower than the thermal conductivity of pure copper. Therefore, it is desirable to control the proportion of precipitates in the electrode core material so that the electrode core material maintains a thermal conductivity of greater than about 250 $W \cdot m^{-1} \cdot K^{-1}$. For example, the electrode core material preferably has a thermal conductivity of between 250 $W \cdot m^{-1} \cdot K^{-1}$ and 350 $W \cdot m^{-1} \cdot K^{-1}$, but this is not necessary or required. According to one exemplary embodiment, the precipitates may account for about 0.05-3.0 wt % of the overall electrode core material, the copper (Cu) matrix may account for about 94.5-99.94 wt % of the overall electrode core material, and impurities like Zn, Sn and Pb may account for up to about 2 wt % of the overall electrode core material.

The copper (Cu) matrix of the electrode core material may be a copper-based material including a plurality of fused copper (Cu) grains throughout which the precipitates are dispersed. The term "copper-based material," as used herein, broadly includes any material or alloy where copper (Cu) is the single largest constituent of the material, based upon the overall weight of the material. This may include materials having greater than 50 wt % copper (Cu), as well as those having less than 50 wt % copper (Cu), so long as copper (Cu) is the single largest constituent. For example, the copper-based material may be an oxygen-free copper (OFC) alloy having a copper (Cu) content of greater than 99.95 wt %.

The precipitates in the electrode core material may constitute an incoherent phase comprising a plurality of fine particles uniformly dispersed throughout the copper (Cu) matrix. The precipitates may be referred to as "incoherent," in that there is little or no matching between the lattice orientation of the precpitates and that of the copper (Cu) matrix. In one embodiment, the precipitates include some combination of iron (Fe), phosphorus (P), beryllium (Be), cobalt (Co), nickel (Ni) and/or silicon (Si), and form particles (e.g., particles made of iron (Fe), iron phosphoride (FeP, $Fe_2P$ and $Fe_3P$), beryllium (Be) and nickel silicide ($Ni_2Si$)) with mean particle diameters of less than about 2 μm. For example, the precipitates may have a mean particle diameter between 0.01 μm and 1 μm. Three different exemplary precipitate-strengthened copper alloys are disclosed below: a Cu—Fe—P alloy, a Cu—Fe—Be—Co alloy and a Cu—Ni—Si alloy.

According to the Cu—Fe—P alloy example, the iron (Fe) and the phosphorous (P) may react to form particles of iron and iron phosphoride (FeP, $Fe_2P$ and $Fe_3P$) that are then dispersed throughout the copper matrix. The amount of iron (Fe) in the precipitate-strengthened copper alloy may be: greater than or equal to 0.01 wt %, 0.05 wt %, 0.1 wt %, 0.5 wt %, 0.75 wt %; less than or equal to 5.0 wt %, 4.0 wt %, 3.0 wt %, or 1.5 wt %; or between 0.01-5.0 wt %, 0.05-5.0 wt %, 0.1-4.0 wt %, 0.5-3.0 wt %, or 0.75-1.5 wt %. The amount of phosphorus (P) in the precipitate-strengthened copper alloy may be: greater than or equal to 0.005 wt %, 0.01 wt %, 0.025 wt %, 0.05 wt %, 0.075 wt %; less than or equal to 0.5 wt %, 0.4 wt %, 0.3 wt %, or 0.15 wt %; or between 0.005-0.5 wt %, 0.01-0.5 wt %, 0.025-0.4 wt %, 0.05-0.3 wt %, or 0.075-0.15 wt %. According to one particular embodiment, the precipitate-strengthened copper alloy comprises iron (Fe) from about 0.01 wt % to 3.0 wt %, inclusive, phosphorus (P) from about 0.01 wt % to 0.4 wt %, inclusive, and the balance copper (Cu). Although alloys including copper, iron and phosphorous (i.e., Cu—Fe—P alloys) may be used with any suitable core configuration, as explained above, they are sometimes particularly well suited for use with longer cores like that shown in FIGS. 1 and 2. In such "longer cores," the thermally conductive core 32 starts from a position near the free end 24 of the shell, extends through the bend 36, and terminates near the firing tip 26 of the ground electrode. This particular combination of core configuration and core composition may result in a particularly desirable spark plug electrode that balances both thermal conductivity and electrode creep resistance. Of course, an electrode core material made from a Cu—Fe—P alloy may be used with other core configurations as well, as the above-described embodiment is only one of the possibilities.

Some preferred examples of precipitate-strengthened copper alloys that may be used in a ground electrode, a center electrode or both, include the following materials that all have copper, iron and phosphorus (the following compositions are given in weight percentage, and the copper (Cu) constitutes the balance): Cu-(0.05-0.15)Fe-(0.025-0.04)P; Cu-(2.1-2.6)Fe-(0.015-0.15)P; Cu-0.72Fe-0.31P; and Cu-(0.8-1.2)Fe-(0.01-0.04)P.

According to the Cu—Fe—Be—Co alloy example, the precipitate-strengthened copper alloy may include copper (Cu), iron (Fe), beryllium (Be), and cobalt (Co) such that dispersed Be particles strengthen the copper matrix. For example, the precipitate-strengthened copper alloy may include about 0.2 wt % Fe, from about 0.15 wt % to about 0.5 wt % Be, inclusive, and from about 0.35 wt % to about 0.6 wt % Co, inclusive, with the balance being Cu. According to the Cu—Ni—Si alloy example, the precipitate-strengthened copper alloy uses nickel silicide ($Ni_2Si$) particles to strengthen the copper matrix, and includes from about 2.2 wt % to about 4.2 wt % Ni, inclusive, and from about 0.25 wt % to about 1.2 wt % Si, inclusive, with the balance being Cu. Other precipitate-strengthening alloy compositions and materials are certainly possible, as the above-mentioned examples represent only some of the possibilities.

Figure 5:
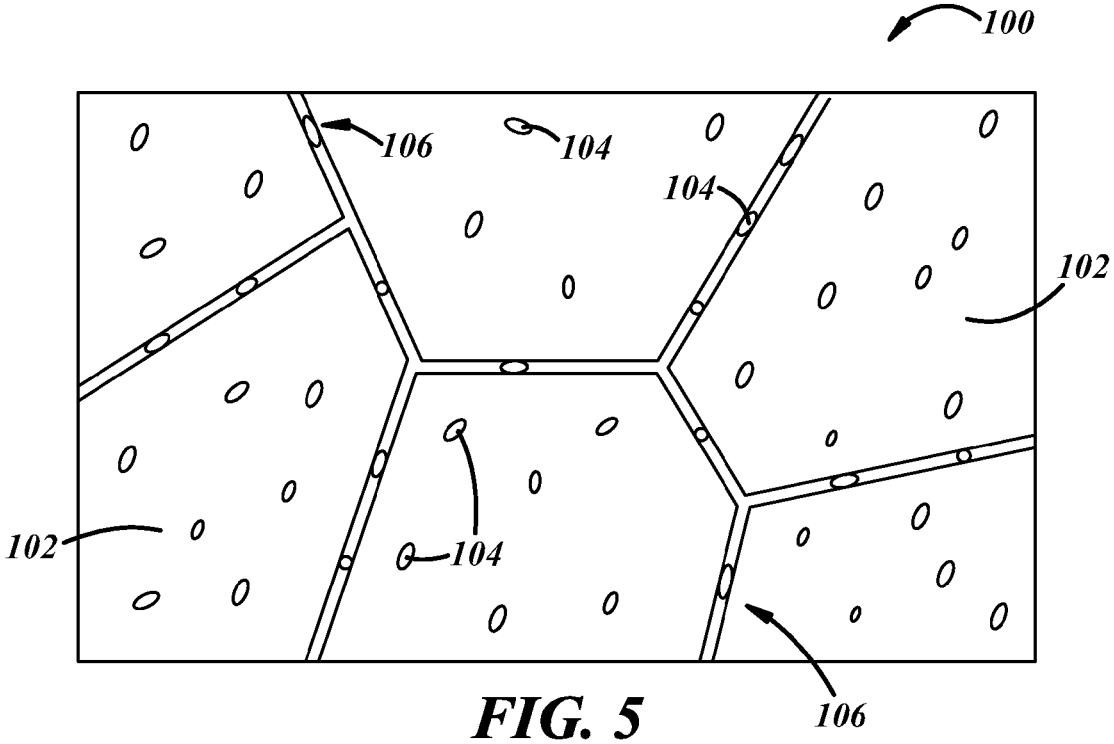
FIG. 5 is a schematic cross-sectional illustration of an exemplary electrode core material, where the electrode core material is a precipitate-strengthened copper alloy that includes a copper (Cu) matrix and precipitates dispersed within the copper (Cu) matrix.

As discussed above, the electrode core material is a precipitate-strengthened copper alloy and exhibits a multi-phase microstructure, with a copper (Cu) matrix phase being distinct or distinguishable from a particulate phase. FIG. 5 is a schematic illustration of an exemplary electrode core material 100, which is a precipitate-strengthened copper alloy and includes a plurality of copper (Cu) grains 102 and a plurality of precipitate particles 104 dispersed throughout the electrode core material 100. The precipitate particles 104 may be primarily located within the copper grains 102, however, with some processing steps that utilize cold working and recrystallization techniques, for example, some of the precipitate particles 104 could be located along the grain boundaries 106.

In manufacture, the precipitate-strengthened copper alloy may be made according to a number of different metallurgical and other techniques. Skilled artisans will appreciate that the solubility of iron (Fe) and phosphorous (P) in copper (Cu) is quite low (e.g., the solubility of Fe in Cu is about 0.14 wt %). Thus, in a copper-based alloy with a saturated amount of iron (Fe) (e.g., more than 0.14 wt % Fe), the iron will likely precipitate out as a strengthening phase. Because phosphorous (P) is a fairly active element, it can react with the iron (Fe) to form an iron phosphoride phase. Thus, in the exemplary Cu—Fe—P alloys described above, it is expected that iron (Fe) and iron phosphorides (FeP, $Fe_2P$ and $Fe_3P$) will form precipitate phases. The following process is a non-limiting example of a process that may be used to form one of the precipitate-strengthened copper alloys described herein; other methods may certainly be used instead.

To form a precipitate-strengthened copper alloy, the copper alloy may first be solution treated (e.g., at about 850° C. for approximately 1-2 hours). After solution treatment, the copper alloy may then be quenched in water, with a suitable aging treatment to follow (e.g., at about 450-550° C. for approximately 2 hours). In order to enhance the formation of the precipitates in the copper alloy, cold working techniques such as rolling and extrusion can be applied in between the solution treatment and the aging treatment steps described above. An example of a potential cold working technique involves deformation of about 20-40%, but others may be used instead. In the Cu—Fe—P alloy described above, the aforementioned steps may be used to enhance the formation of iron (Fe) and iron-phosphoride (FeP, $Fe_2P$ and $Fe_3P$) precipitates with a regular or average particle size of about 1 μm. To form the nickel-based cladding or sheath around the electrode core material, the precipitate-strengthened copper alloy is inserted or stuffed into a tube-like cladding structure having an outer diameter of about 2 mm-5 mm and a cladding wall thickness of less than about 1.5 mm, for example. Then, in step 270, the core material and the cladding structure are extruded together to form a spark plug electrode material. If an elongated wire is desired, then the core material and the cladding structure may be cold extruded to form a fine wire having a diameter of about 1 mm to about 3 mm, inclusive, which in turn can be cut or cross-sectioned into individual pieces of a desired length. After the core material and the cladding structure have been co-extruded, any number of different post-processing techniques may be used, including welding techniques that attach one or more precious metal tips to the resulting electrodes.

The cladding structure may be made of a material having high thermal stability and corrosion resistant properties, such as nickel (Ni), iron (Fe), cobalt (Co), or an alloy thereof. Preferably, the cladding material is a nickel-based material comprising nickel (Ni) and at least one of: aluminum (Al), chromium (Cr), manganese (Mn), silicon (Si), titanium (Ti), yttrium (Y), zirconium (Zr), or mixtures thereof. The term "nickel-based material," as used herein, broadly includes any material or alloy where nickel (Ni) is the single largest constituent of the material, based upon the overall weight of the material. This may include materials having greater than 50 wt % nickel (Ni), as well as those having less than 50 wt % nickel (Ni), so long as nickel (Ni) is the single largest constituent. Any of the following alloy systems are suitable for the cladding material: Ni—Al—Si—Y, Ni—Cr, Ni—Cr—Mn—Si, Ni—Cr—Al, Ni—Cr—Al—Mn—Si, and Ni—Cr—Mn—Si—Ti—Zr. Some preferred examples of cladding materials that may be used in a ground electrode, a center electrode or both, include the following (the following compositions are given in weight percentage, and the nickel (Ni) constitutes the balance): Ni-(1.0-1.5)A1-(1.0-1.5)Si-(0.1-0.2)Y and Ni-(1.65-1.90)Cr-(1.8-2.1)Mn-(0.35-0.55)Si-(0.2-0.4)Ti-(0.1-0.2)Zr, as well as materials that go by the trade names Inconel 600 and Inconel 601.

Figure 6:
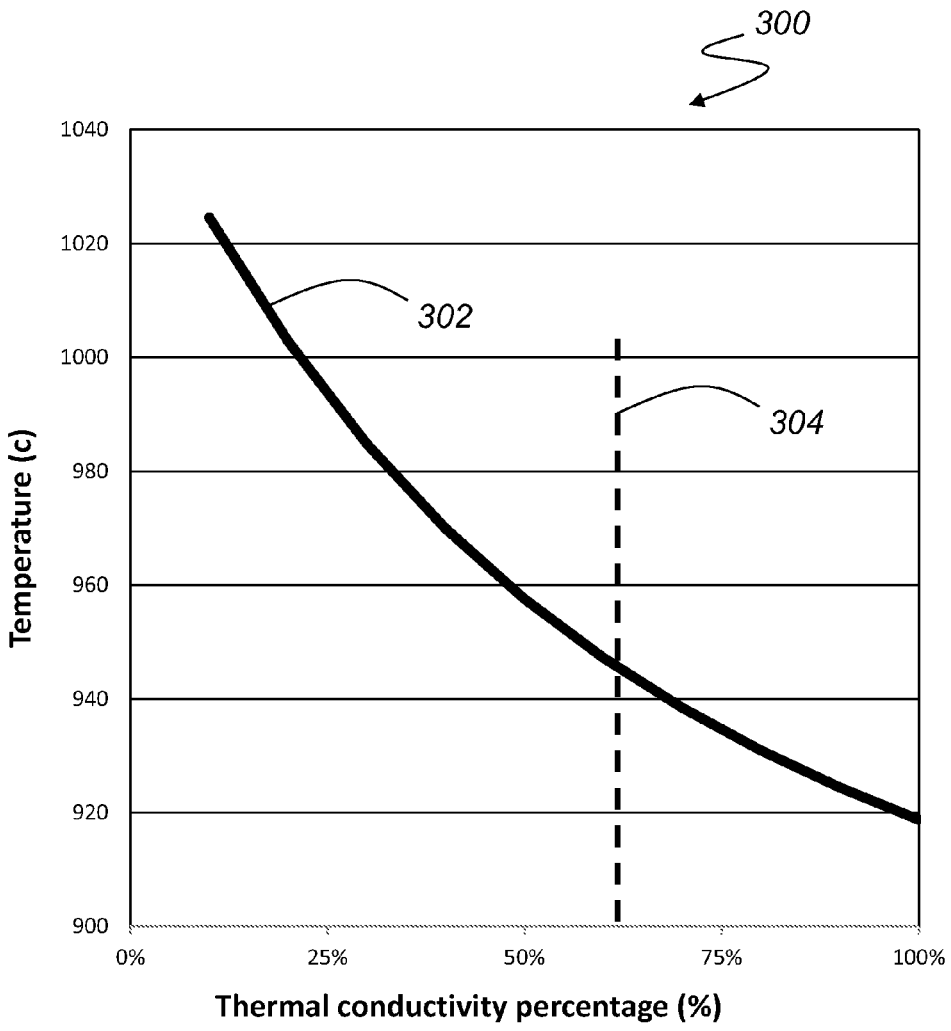
FIG. 6 is a chart demonstrating temperature dependence for an exemplary spark plug electrode, where the temperature dependence is based on the electrode core material.

With reference now to FIG. 6, there is shown a chart 300 that demonstrates the temperature dependency for an exemplary spark plug electrode having a "longer core," like the one shown in FIGS. 1 and 2, where the operating temperature at the firing end of a ground electrode (y-axis) varies based on the electrode core material (x-axis). As illustrated by curve 302, the higher the thermal conductivity of the copper core (using the percentage of thermal conductivity of pure copper or oxygen-free copper (OFC) in the electrode core material—100% thermal conductivity percentage (%) means the thermal conductivity of oxygen-free copper (OFC)—the lower the temperature out at the firing end of the ground electrode 18. However, electrode core materials made with very high percentages of copper can sometimes exhibit the relaxation and/or swelling phenomena described above. It is therefore desirable to provide an electrode core material that achieves both the thermal conductivity objectives of such plugs, yet also exhibits enough strength and integrity to be significantly "creep-resistant" and avoid electrode deformation. FIG. 6 shows one non-limiting example of such a material, as broken line 304 represents a minimum threshold of thermal conductivity such that the electrode core materials described herein with more than about 60% copper (which corresponds to a minimum thermal conductivity of 250 $W \cdot m^{-1} \cdot K^{-1}$) will generally result in a low enough temperature at the electrode tip to avoid significant corrosion and erosion due to excessive heat and maintain microstructure stability. Such electrode core materials may include the following exemplary compositions: Cu-(0.05-0.15)Fe-(0.025-0.04)P; Cu-(2.1-2.6)Fe-(0.015-0.15)P; Cu-0.72Fe-0.31P; and Cu-(0.8-1.2)Fe-(0.01-0.04)P.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. An electrode core material for use in a spark plug electrode, comprising:

a copper matrix made of a copper-based material, wherein copper is the single largest constituent of the copper matrix by weight; and a plurality of precipitates dispersed in the copper matrix, wherein the precipitates include iron and phosphorus such that the electrode core material comprises iron from about 0.01 wt % to 5.0 wt %, inclusive, phosphorus from about 0.02 wt % to 0.5 wt %, inclusive, and the balance substantially copper, and the precipitates strengthen the copper matrix so that the electrode core material is a precipitate-strengthened copper alloy.

2. The electrode core material of claim 1, wherein the electrode core material comprises the copper matrix from about 94.5 wt % to 99.94 wt %, inclusive, and the precipitates from about 0.05 wt % to 3.0 wt %, inclusive.

3. The electrode core material of claim 1, wherein the electrode core material comprises iron from about 0.1 wt % to 3.0 wt %, inclusive, phosphorus from about 0.02 wt % to 0.4 wt %, inclusive, and the balance substantially copper.

4. The electrode core material of claim 1, wherein copper is the single largest constituent of the electrode core material by weight, and iron is the second largest constituent of the electrode core material by weight.

5. An electrode core material for use in a spark plug electrode, comprising:

a copper matrix made of a copper-based material, wherein copper is the single largest constituent of the copper matrix by weight; and a plurality of precipitates dispersed in the copper matrix, wherein the precipitates include iron, beryllium and cobalt such that the electrode core material comprises iron from about 0.01 wt % to 5.0 wt %, inclusive, beryllium from about 0.15 wt % to 0.5 wt %, inclusive, cobalt from about 0.35 wt % to 0.6 wt %, inclusive, and the balance substantially copper, and the precipitates strengthen the copper matrix so that the electrode core material is a precipitate-strengthened copper alloy.

6. An electrode core material for use in a spark plug electrode, comprising:

a copper matrix made of a copper-based material, wherein copper is the single largest constituent of the copper matrix by weight; and a plurality of precipitates dispersed in the copper matrix, wherein the precipitates include nickel and silicon such that the electrode core material comprises nickel from about 2.2 wt % to 4.2 wt %, inclusive, silicon from about 0.25 wt % to 1.2 wt %, inclusive, and the balance substantially copper, and the precipitates strengthen the copper matrix so that the electrode core material is a precipitate-strengthened copper alloy.

7. The electrode core material of claim 1, wherein the precipitates have a mean particle diameter of less than 2 μm.

8. The electrode core material of claim 1, wherein the electrode core material has a thermal conductivity of greater than 250 $W \cdot m^{-1} \cdot K^{-1}$.

9. A spark plug electrode, comprising:

a core made of a precipitate-strengthened copper alloy including a copper matrix and a plurality of precipitates dispersed in the copper matrix, wherein the precipitates include iron and phosphorus such that the core comprises iron from about 0.01 wt % to 5.0 wt %, inclusive, phosphorus from about 0.02 wt % to 0.5 wt %, inclusive, and the balance substantially copper; and a cladding surrounding the core, wherein the cladding is made of a nickel-based material where nickel is the single largest constituent of the nickel-based material by weight.

10. A spark plug, comprising:

a metallic shell having an axial bore;

an insulator being at least partially disposed within the axial bore of the metallic shell, the insulator having an axial bore;

a center electrode being at least partially disposed within the axial bore of the insulator; and a ground electrode being attached to the metallic shell;

the center electrode, the ground electrode, or both the center and ground electrodes including a cladding formed of a nickel-based material and a core comprising a copper matrix and a plurality of precipitates dispersed throughout the copper matrix, wherein the precipitates include iron and phosphorus such that the core comprises iron from about 0.01 wt % to 5.0 wt %, inclusive, phosphorus from about 0.02 wt % to 0.5 wt %, inclusive, and the balance substantially copper.

* * * * *